US006494564B2

(12) United States Patent
Shin et al.

(10) Patent No.: US 6,494,564 B2
(45) Date of Patent: Dec. 17, 2002

(54) PRINT ARRAY HEAD AND FABRICATION METHOD THEREOF

(75) Inventors: Kyu-ho Shin, Suwon (KR); Sung-hee Lee, Suwon (KR); Su-ho Shin, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/978,626

(22) Filed: Oct. 18, 2001

(65) Prior Publication Data

US 2002/0051031 A1 May 2, 2002

(30) Foreign Application Priority Data

Oct. 28, 2000 (KR) ..... 2000-63807

(51) Int. Cl.[7] ..... B41J 2/15
(52) U.S. Cl. ..... 347/40; 347/12; 347/43
(58) Field of Search ..... 347/40, 12, 42, 347/13, 43, 58, 47, 20, 21

(56) References Cited

U.S. PATENT DOCUMENTS 5,719,605 A * 2/1998 Anderson et al. ..... 347/59
6,109,719 A * 8/2000 Cornell ..... 347/14
6,267,472 B1 * 7/2001 Maher et al. ..... 347/65

* cited by examiner

*Primary Examiner*—Lamson Nguyen
(74) *Attorney, Agent, or Firm*—Staas & Halsey LLP

(57) ABSTRACT

A print array head and a fabrication method thereof. The print array head includes a positioning means for aligning coordinates of a nozzle plate of a page width size with coordinates of a heater chip. The positioning means includes a pair of aligning holes formed on opposite sides of a nozzle section of the nozzle plate, and a pair of aligning marks formed on of a recess of the heater chip. Since the nozzle plate and the heater chip are aligned with each other through observation of the aligning marks through the aligning holes, possible error between a desired an and actual attaching location of the heater chip with respect to the nozzle plate is minimized, and accordingly, printing quality and productivity are increased, while the fabricating costs are decreased.

18 Claims, 2 Drawing Sheets

PRINT ARRAY HEAD AND FABRICATION METHOD THEREOF

CROSS-REFERENCE TO RELATED APPLICATIONS

This application claims the benefit of Korean Application No. 2000-63807, filed Oct. 28, 2000, in the Korean Industrial Property Office, the disclosure of which is incorporated herein by reference.

BACKGROUND OF THE INVENTION

1. Field of the Invention

The present invention relates to an inkjet print head and a fabrication method thereof, and more particularly to an array type inkjet print head in which a plurality of nozzle sections on a nozzle plate of a page width size are aligned with a plurality of heater chips, and a fabrication method thereof.

2. Description of the Related Art

Generally, an inkjet print head prints a desired image on a printing medium by instantly heating a plurality of heater chips, thus explosively vaporizing a certain amount of ink charged in ink chambers to cause ink bubbles. That is, by the expansion pressure of the ink bubbles, ink droplets are ejected out through nozzle holes to form a desired image.

As the demand for high resolution printing quality and high speed printing has increased recently, many efforts are made to develop a so-called page width array head that could print image information with a page unit by aligning the plurality of heater chips in a printing width size. Such an inkjet print array head is aimed at simplifying the design and improving the printing speed, and reference can be made to U.S. Pat. Nos. 5,469,199 and 4,851,371 for a detailed example thereof.

In the above-mentioned inkjet print array head, nozzle sections and the heater chips must be attached to each other in a highly accurate alignment. For example, in a printer having a resolution of 600 dpi (dots per inch), misalignment between the nozzle sections and the heater chips of the general inkjet print head is allowable within ±25 $\mu$m, while the misalignment in the page width array head is allowable approximately within only ±12 $\mu$m. However, due to alignment error generated during alignment of the heater chips in the general inkjet print array head, misalignment occurs in the alignment of the nozzle sections and the heater chips, and accordingly, the accuracy of the alignment is limited.

In order to secure high accuracy in the alignment of the nozzle sections and the heater chips during the fabrication process, expensive equipment such as a vision system is required, in addition to labor and other costs. Accordingly, productivity deteriorates while the fabrication costs increase. Also, due to the effect of heat during the operation of the general inkjet print array head, there is a high possibility that the alignment of the heater chips may vary, or distortion may occur due to a crack in the processing section.

Furthermore, the general inkjet print array head usually has a nozzle plate made of a polymer sheet or a metal sheet. Since the metal sheet is processed through an electroforming process to form the nozzle holes, reproductibility deteriorates, and high accuracy is not guaranteed. Also, a distortion occurs due to a residual stress.

SUMMARY OF THE INVENTION

Accordingly, it is an object of the present invention to provide an inkjet print array head and a fabrication method thereof to improve productivity and printing quality by ensuring and maintaining an alignment accuracy between the nozzle sections and the heater chips.

Additional objects and advantages of the invention will be set forth in part in the description which follows and, in part, will be obvious from the description, or may be learned by practice of the invention.

The above and other objects are accomplished by a print array head in accordance with the present invention, including a nozzle plate of a predetermined size having a plurality of nozzle sections formed thereon in a predetermined pattern, each nozzle section comprising a plurality of nozzle holes, a plurality of heater chips aligned with the plurality of nozzle sections and attached to the nozzle plate, an ink supplying channel interconnected to each nozzle section, and a printer bar connected to the nozzle plate, facing the nozzle plate. The present print array head further includes a positioning means for aligning the plurality of heater chips with the plurality of nozzle sections.

According to the present invention, the positioning means includes an aligning hole formed at a predetermined location around each nozzle section, and an aligning mark formed at a predetermined location on each of the heater chips, coordinates of the aligning marks being aligned with coordinates of the aligning holes.

The above and other objects are also accomplished by a method to fabricate a print array head in accordance with the present invention, including forming a plurality of nozzle sections on a nozzle plate in a predetermined pattern, each nozzle section comprising a plurality of holes, forming an aligning hole at a predetermined location around each nozzle section, forming an aligning mark at a predetermined position on each of a plurality of heater chips, forming a pad-type recess on the printer bar, attaching each heater chip to the pad-type recess, and connecting the nozzle plate with the plurality of heater chips with reference to the aligning holes and the aligning marks.

According to one aspect of the present invention, the forming of the plurality of nozzle sections includes applying a photo-resist on both sides of the nozzle plate, exposing the photo-resist to a light in a predetermined pattern by using a mask, and forming a nozzle hole by etching the nozzle plate through a portion of the photo-resist that is exposed to the light and removed.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
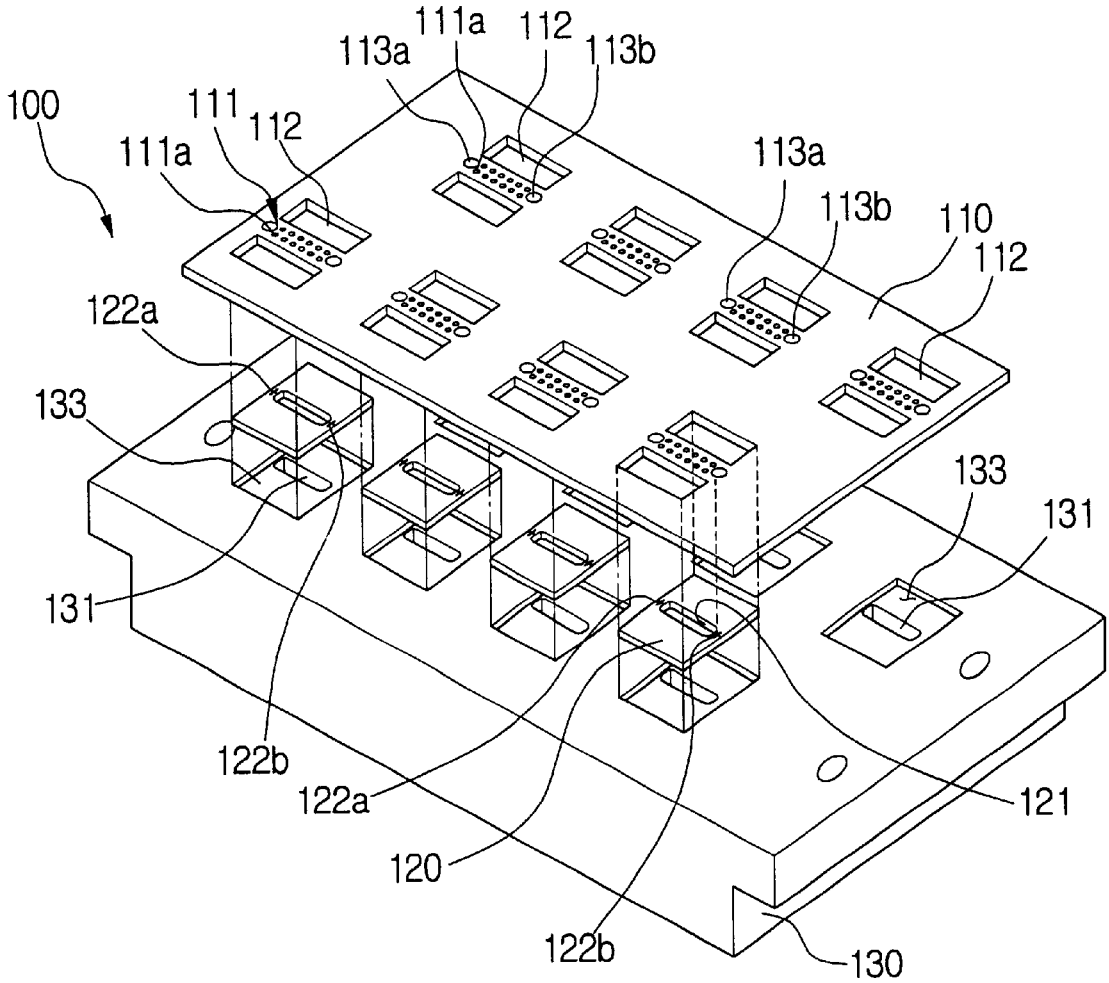
FIG. 1 is a perspective view schematically showing a portion of a print array head in accordance with the present invention.

Reference will now be made in detail to the present preferred embodiments of the present invention, examples of which are illustrated in the accompanying drawings, wherein like reference numerals refer to like elements throughout.

Referring to FIG. 1, an inkjet print array head 100 in accordance with the present invention includes a plurality of nozzle sections 111 each having a plurality of nozzle holes 111*a* formed thereon in a predetermined pattern, and a nozzle plate 110 of a predetermined page width size.

Heater chips 120 are attached to an underside of the nozzle plate 110 to correspond to the nozzle sections 111, respectively. The heater chips 120 are also interposed between the nozzle plate 110 and a printer bar 130 that faces the nozzle plate 110. FPC connecting openings 112 connect flexible printed circuits (FPC, not shown) to the heater chips 120.

A positioning means is provided to align coordinates of the nozzle plate 110 and the heater chips 120. The positioning means includes a pair of aligning holes 113*a* and 113*b* formed on the nozzle plate 110 on opposite sides of each nozzle section 111.

In order for a user to ensure exact coordinate alignment through his/her observation through the pair of aligning holes 113*a* and 113*b*, there is provided a pair of aligning marks 122*a* and 122*b* formed on each heater chip 120 on opposite sides of an ink hole 121.

The distance between the pair of aligning holes 113*a* and 113*b* substantially corresponds to the distance between the pair of aligning marks 122*a* and 122*b*. Accordingly, the aligning marks 122*a* and 122*b* are positioned to be aligned with the aligning holes 113*a* and 113*b*, respectively.

With the positioning means constructed as above, the heater chips 120 are attached to the underside of the nozzle sections 111 of the nozzle plate 110, such that the aligning holes 113*a* and 113*b* are coordinate-aligned with the aligning marks 122*a* and 122*b*.

If the heater chips 120 are attached to the underside of the nozzle plate 110 in the aligned state, the heater chips 120 are seated on a plurality of pad-type recesses 133 formed on the printer bar 130 when the nozzle plate 110 is facingly attached to the printer bar 130.

The printer bar 130 has ink channels 131 interconnected to the nozzle sections 111, and ink chambers (not shown). The ink holes 121 are formed in the middle of the heater chips 120 to interconnect the nozzle sections 111 with the ink channels 131. The ink channels 131 are formed in the middle of the pad-type recesses 133. The external configuration (size and rectangular shape) of the combination of each nozzle section 111, pair of aligning holes 113*a* and 113*b*, and FPC connecting opening 112 corresponds to the external configuration of each pad-type recess 133, and the external configuration of each heater chip 120.

Each heater chip 120 is attached to the underside of the nozzle plate 110 by thermal pressure bonding after being aligned with reference to the coordinates of the pair of aligning holes 113*a* and 113*b* and the pair of aligning marks 122*a* and 122*b*. After the heater chips 120 are attached to the nozzle plate 110, the nozzle plate 110 is connected on the printer bar 130 by an adhesive applied in the pad-type recesses 133, in a manner such that the heater chips 120 are seated in the pad-type recesses 133 of the printer bar 130. By doing so, misalignment of the nozzle sections 111, the heater chips 120, and the ink channels 131 is minimized.

Furthermore, in the inkjet print array head 100 in accordance with the present invention, since the heater chips 120 are seated and then bonded in the pad-type recesses 133 formed in the printer bar 130, there is little effect from heat, and accordingly, any distortion due to heat is prevented.

A method to fabricate the inkjet print array head 100 will now be described. According to the fabrication method, the plurality of nozzle sections 111 comprised of the group of nozzle holes 111*a* are formed in the nozzle plate 110 that is made in a page width size. Then, the heater chips 120 are attached to the nozzle plate 110 such that they correspond to the nozzle sections 111. The nozzle plate 110 is made of a polymer sheet as in the general inkjet print head, or alternately can be made of a metal sheet such as copper (Cu), stainless steel, or nickel (Ni). The nozzle holes 111*a* are formed by excimer processing when the nozzle plate 110 is made of a polymer sheet.

When the nozzle plate 110 is made of a metal sheet, however, the nozzle holes 111 are formed by a semiconductor chip fabricating process known as photolithography. The nozzle hole 111*a* processing is now described with reference to FIGS. 2A through 2E.

Figure 2A:
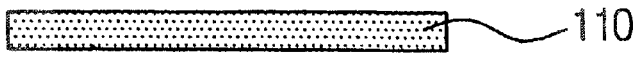
FIGS. 2A through 2E are sectional views schematically showing a process of fabricating a nozzle plate of the print array head in accordance with the present invention.
Figure 2B:
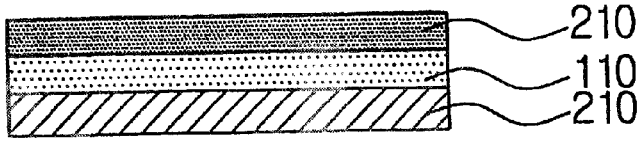
Figure 2C:
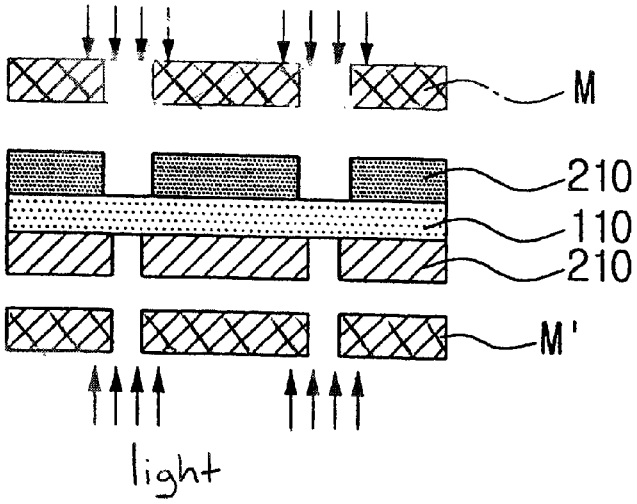

First, as shown in FIGS. 2A and 2B, photo-resists 210 are applied on both sides of the nozzle plate 110 having a thickness from approximately 20 $\mu$m to 30 $\mu$m. Next, as shown in FIG. 2C, the photo-resists 210 are exposed to light by using metal masks M and M' having processing holes in a pattern identical to the nozzle hole pattern. Then, the exposed portions of the photo-resists 210 are removed.

The metal masks M and M' have holes of different diameters, thereby forming nozzle holes 111*a* of varying inner diameter.

Figure 2D:
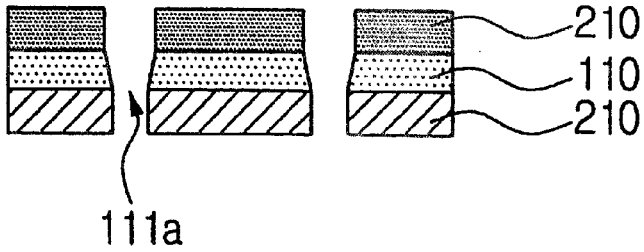
Figure 2E:
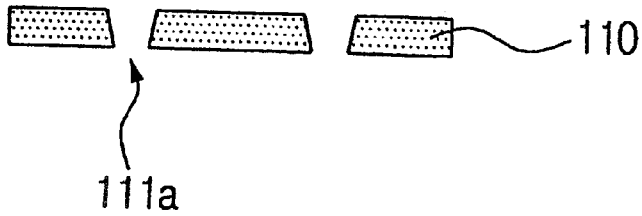

As shown in FIG. 2D, through the removing portions of the photo-resists 210, corresponding portions are etched. As a result, a plurality of nozzle holes 111*a* are defined, forming a nozzle section 111. The photo-resists 210 are then removed. The nozzle holes 111*a* may also be formed by photo engraving the photo-resists 210.

The aligning holes 113*a* and 113*b* are formed by photolithography and the aligning marks 122*a* and 122*b* are formed by photoengraving, or the like. The printer bar 130 is made by a separate process. The pad-type recesses 133 of the printer bar 130 may be formed by etching or any other known method.

After the series of above-described processes, the heater chips 120 are aligned with the nozzle plate 110 in a manner such that the aligning holes 113*a* and 113*b* are aligned with the aligning marks 122*a* and 122*b*. The heater chips 120 are then attached to the nozzle plate 110 by thermal pressure bonding. The possible error between the ideal and actual attaching position of the heater chips 120 to the nozzle plate 110 is below ±5 $\mu$m. The alignment of the heater chips 120 and the nozzle plate 110 can be performed by any method, for example, manually by an operator or automatically by a machine.

Next, an adhesive is applied on the bottoms of the pad-type recesses 133 of the printer bar 130, to electrically connect the heater chips 120 to FPCs that are connected to a power supply (not shown) by attaching the leading ends of the FPCs with the adhesive. Then, the inkjet print array head 100 is completed by facingly attaching the nozzle plate 110 to the printer bar 130 such that the heater chips 120 are seated in the pad-type recesses 133. Since the heater chips 120 are guided along the pad-type recesses 133 of the printer bar 130, relative alignment of the nozzle sections 111 and the heater chips 120 of the nozzle plate 110, and the ink channels 131 of the printer bar 130 is precise. Furthermore, since the nozzle plate 110 is made of a thin plate, in order to prevent distortion or bending during the attachment to the printer bar 130, the nozzle plate 110 is attached to the printer bar 130 while being gripped by a separate pressing jig.

According to another aspect of the present invention, the heater chips 120 are attached to be seated in the pad-type recesses 133 of the printer bar 130, and then the nozzle plate 110 is attached to the heater chips 120 and the printer bar 130 by making reference to the aligning holes 113*a* and 113*b* and the aligning marks 122*a* and 122*b*, respectively.

As described above, according to the inkjet print array head 100 in accordance with the present invention, since the positioning means is provided to align the nozzle plate 110 and the printer bar 130, the error of the aligning position of the heater chips 120 between the nozzle plate 110 and the printer bar 130 is minimized.

Accordingly, the inkjet print array head 100 in accordance with the present invention improves accuracy when ejecting ink and thus improves printing quality. Also, since the effect from the heat to the heater chips 120 is minimized, printer life span is increased. Furthermore, since there is no need to employ expensive equipment for accurate alignment of the heater chips 120, reproduction and fabrication costs are decreased, while productivity is increased.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A print array head, comprising:

a nozzle plate of a predetermined size having a plurality of nozzle sections formed thereon in a predetermined pattern, each of the nozzle sections comprising a plurality of nozzle holes;

a plurality of heater chips aligned with the plurality of nozzle sections, respectively, and attached to the nozzle plate;

a plurality of ink supplying channels, interconnected to the plurality of nozzle sections;

a printer bar connected to the nozzle plate, facing the nozzle plate; and positioning means for aligning the plurality of heater chips with the plurality of nozzle sections, the positioning means comprising a plurality of aligning holes, each of the aligning holes formed at a predetermined location around one of the nozzle sections, and a plurality of aligning marks, each of the aligning marks formed at a predetermined location on one of the heater chips, the plurality of aligning marks being aligned with the plurality of aligning holes.

2. The print array head of claim 1, wherein each of the heater chips comprises a portion defining a hole that interconnects the plurality of nozzle sections with the ink supplying channels.

3. The print array head of claim 1, wherein the nozzle plate is made of one of copper, nickel, and stainless steel.

4. A method of fabricating a print array head, comprising:

forming a plurality of nozzle sections on a nozzle plate in a predetermined pattern, each of the nozzle sections comprising a plurality of nozzle holes;

forming an aligning hole at a predetermined location around each nozzle section;

forming a plurality of aligning marks at predetermined locations on a plurality of heater chips;

forming a plurality of pad-type recesses on the printer bar;

attaching the heater chips to the pad-type recesses; and connecting the nozzle plate with the plurality of heater chips with reference to the aligning holes and the aligning marks.

5. The method of claim 4, wherein the forming of the plurality of nozzle sections comprises:

applying a photo-resist on both sides of the nozzle plate;

exposing the photo-resist to a light in a predetermined pattern;

forming the nozzle holes by etching the nozzle plate through a portion of the photo-resist that is exposed to the light; and removing the photo-resist.

6. A print array head, comprising:

a nozzle plate having a nozzle section formed thereon;

a heater chip aligned with the nozzle section and attached to the nozzle plate;

a printer bar connected to the nozzle plate; and a positioning unit to align the heater chip with the nozzle section, the positioning unit comprising:

a first aligning hole formed in the nozzle plate, and a first aligning mark formed on the heater chip, the first aligning mark being aligned with the first aligning hole.

7. The print array head of claim 6, wherein the nozzle section comprises a nozzle hole in fluid communication with an ink channel formed in the printer bar.

8. The print array head of claim 7, wherein the printer bar comprises a recess to seat the heater chip.

9. The print array head of claim 8, further comprising:

a second aligning mark, the first and second aligning marks being formed on opposite sides of the recess; and a second aligning hole, the first and second aligning holes being formed on opposite sides of the nozzle section, wherein a distance between the first and second aligning marks corresponds to a distance between the first and second aligning holes.

10. The print array head of claim 9, wherein the heater chip is attached to the nozzle plate by thermal pressure bonding.

11. The print array head of claim 10, wherein the nozzle plate comprises a polymer sheet.

12. The print array head of claim 10, wherein the nozzle plate is made of one of copper, nickel and stainless steel.

13. The print array head of claim 10, wherein a difference between an actual and a desired position of the heater chip on the nozzle plate is less than 5 microns.

14. A print array head, comprising:

a nozzle plate having a nozzle section formed thereon;

a heater chip aligned with the nozzle section and attached to the nozzle plate; and a positioning unit to align the heater chip with the nozzle section, a difference between an actual and a desired position of the heater chip on the nozzle plate being less than 5 microns.

15. A method to fabricate a print array head, comprising:

forming a plurality of nozzle sections in a nozzle plate;

attaching a plurality of heater chips to the nozzle sections;

forming a plurality of aligning holes corresponding to the nozzle sections in the nozzle plate;

forming a plurality of aligning marks on the heater chips;

aligning the aligning marks with the aligning holes; and attaching the nozzle plate to a printer bar.

16. The method of claim 15, wherein the printer bar comprises a plurality of recesses to receive the heater chips such that the heater chips are between the nozzle plate and the printer bar.

17. The method of claim 16, wherein the heater chips are first attached to the nozzle sections, and then the heater chips are received by the recesses.

18. The method of claim 16, wherein the heater chips are first received by the recesses, and then attached to the nozzle sections.

* * * * *